US008295727B2

(12) United States Patent
Sato

(10) Patent No.: US 8,295,727 B2
(45) Date of Patent: Oct. 23, 2012

(54) IMAGE FORMING APPARATUS WITH TEMPERATURE ADJUSTMENT

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 280 days.

(21) Appl. No.: 12/722,628

(22) Filed: Mar. 12, 2010

(65) Prior Publication Data

US 2010/0239300 A1 Sep. 23, 2010

(30) Foreign Application Priority Data

Mar. 17, 2009 (JP) ..... 2009-064904

(51) Int. Cl.
*G03G 15/20* (2006.01)

(52) U.S. Cl. ..... 399/69

(58) Field of Classification Search ..... 399/69, 399/67

See application file for complete search history.

(56) References Cited

U.S. PATENT DOCUMENTS 5,555,075 A * 9/1996 Fukano et al. ..... 399/69

FOREIGN PATENT DOCUMENTS

| | | | |
|---|---|---|---|
| JP | 03-209492 | A | 9/1991 |
| JP | 2003-156966 | A | 5/2003 |
| JP | 2006-154005 | A | 6/2006 |
| JP | 2006-171237 | A | 6/2006 |

* cited by examiner

*Primary Examiner* — Quana M Grainger
(74) *Attorney, Agent, or Firm* — Marvin A. Motsenbocker; Mots Law, PLLC

(57) ABSTRACT

An image forming apparatus includes: a heat transfer member having a width extending along a direction orthogonal to a medium conveying direction along which a medium is conveyed, the heat transfer member transferring heat from a heater to the medium; the heater provided along substantially the entire width of the heat transfer member and configured to heat the heat transfer member so as to heat the medium via the heat transfer member; a temperature detector configured to detect the temperature of the widthwise center of the heat transfer member; a temperature setting unit configured to set a target temperature by correcting a default target temperature, depending on the difference between the default target temperature and the temperature that is detected by the temperature detector when the heater starts to heat; a heat controller configured to control the heater to make the temperature detected by the temperature detector the target temperature.

21 Claims, 14 Drawing Sheets

CORRECTION VALUE $$Tcomp = -15/70 \times \Delta T + 15$$

$$Tsp = Tprn + Tcomp$$

CORRECTION VALUE $T_{comp} = -15 / 60 \times \Delta T + 25$ $T_{sp} = T_{prn} + T_{comp}$

IMAGE FORMING APPARATUS WITH TEMPERATURE ADJUSTMENT

CROSS REFERENCE TO RELATED APPLICATIONS

This application claims priority based on 35 USC 119 from prior Japanese Patent Application No. 2009-064904 filed on Mar. 17, 2009, entitled "Image forming apparatus", the entire contents of which are incorporated herein by reference.

BACKGROUND OF THE INVENTION

1. Field of the Invention

The invention relates to an image forming apparatus having a fixing unit to fix a toner image to a medium.

2. Description of Related Art

A conventional image forming apparatus includes a fixing unit which fixes a toner image corresponding to a print image to a medium such as paper by heating and pressing the medium to which the toner image is attached (see, for example, Japanese Patent Application Laid-Open No. 2006-147237). The fixing unit includes: a heat transfer member which has its width extending along a direction orthogonal to a medium conveying direction and configured to be in contact with the medium; a heater configured to heat the entire width of the heat transfer member so as to heat the medium via the heat transfer member; and a thermistor configured to detect a temperature of the widthwise center of the heat transfer member. The heater is controlled based on the temperature detected by the thermistor, to heat the heat transfer member to the target temperature.

SUMMARY OF THE INVENTION

However, the conventional image forming apparatus has a problem that the widthwise center and the widthwise end of the heat transfer member have different temperatures, which causes a fixing failure.

An aspect of the invention is an image forming apparatus that includes: a heat transfer member having a width extending along a direction orthogonal to a medium conveying direction along which a medium is conveyed, the heat transfer member transferring heat from a heater to the medium; the heater provided along substantially the entire width of the heat transfer member and configured to heat the heat transfer member so as to heat the medium via the heat transfer member; a temperature detector configured to detect the temperature of the widthwise center of the heat transfer member; a heat controller configured to control the heater to make the temperature detected by the temperature detector a target temperature; a correction unit configured correct the target temperature, depending on a difference between the target temperature and the temperature that is detected by the temperature detector when the heater starts to heat.

Another aspect of the invention is an image forming apparatus that includes: a heat transfer member having a width extending along a direction orthogonal to a medium conveying direction along which a medium is conveyed, the heat transfer member transferring heat from a heater to the medium; the heater provided along substantially the entire width of the heat transfer member and configured to heat the heat transfer member so as to heat the medium via the heat transfer member; a temperature detector configured to detect temperature of the widthwise center of the heat transfer member; a temperature setting unit configured to set a target temperature based on a comparison in which a predetermined temperature is compared with a temperature that is detected by the temperature detector when the heater starts to heat; a heat controller configured to control the heater to make the temperature detected by the temperature detector the target temperature.

According to the aspects, the temperatures of the widthwise end of the heat transfer member as well as the temperature of the widthwise center of the heat transfer member are to be within a preferred fixing temperature range. This prevents a fixing failure at the widthwise end of the heat transfer member. In addition, the aspects do not require a temperature detector that is provided at the widthwise end of heat transfer member, thereby reducing the number of components of the image forming apparatus.

DETAILED DESCRIPTION OF THE EMBODIMENTS

Figure 1A:
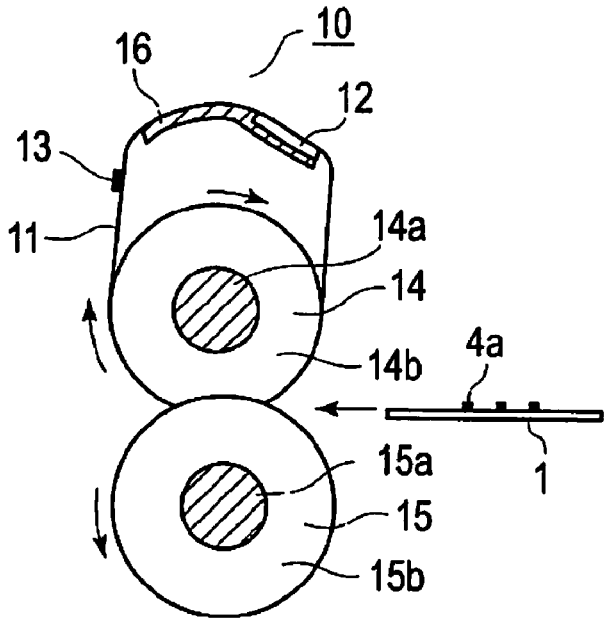
FIGS. 1A and 1B shows diagrams of fixing unit 10 shown in FIG. 2 according to a first embodiment of the invention.

Hereinafter, embodiments of the invention will be described with reference to the drawings. In the respective drawings referenced herein, the same constituents are designated by the same reference numerals and duplicate explanation concerning the same constituents is omitted. All of the drawings are provided to illustrate the respective examples only and do not limit the scope of the invention. No dimensional proportions in the drawings shall impose a restriction on the embodiments. For this reason, specific dimensions and the like should be interpreted with the following descriptions taken into consideration. In addition, the drawings may include parts whose dimensional relationship and ratios are different from one drawing to another.

First Embodiment

Configuration of the First Embodiment

Figure 2:
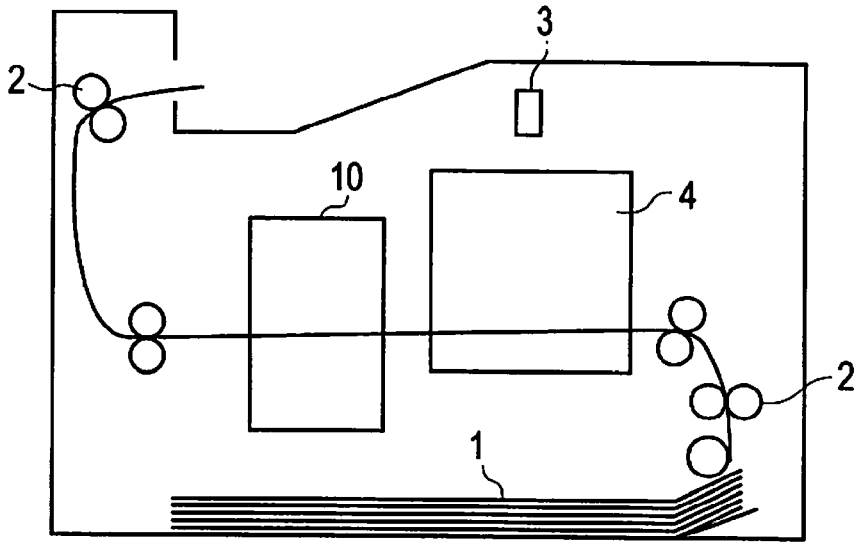
FIG. 2 is a diagram of an image forming apparatus according to the first embodiment.

FIG. 2 is a diagram of an image forming apparatus according to the first embodiment of the invention.

The image forming apparatus in the first embodiment is a printer. The image forming apparatus includes sheet convey unit 2 configured to convey a medium 1 (for example, a paper sheet) along a medium convey path. Exposure head 3, toner image forming unit 4, fixing unit 10, and the like are provided along the medium convey path. Exposure head 3 is, for example, LED (Light Emitting Diode) exposure head 3 and is configured to emit a recording light. Toner image forming unit 4 is provided near LED exposure head 3 and is configured to form a toner image corresponding to the recording light. Fixing unit 10 is provided downstream of toner image forming unit 4 in the medium convey path and is configured to fix the toner image onto the medium.

Figure 3:
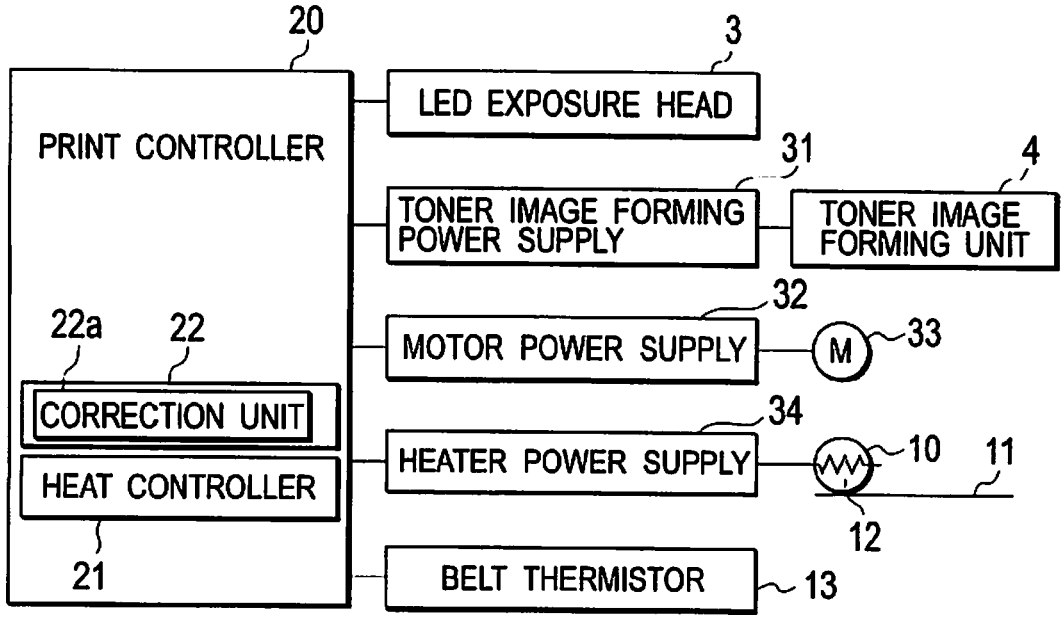
FIG. 3 is a block diagram of a configuration of a control device for controlling the image forming apparatus shown in FIG. 2.

FIG. 3 is a block diagram of the configuration of a control device for controlling the image forming apparatus shown in FIG. 2.

The control device includes print controller 20 comprising a central processing unit (hereinafter referred to as "CPU") or the like and configured to control the printing operation of the image forming apparatus. Print controller 20 is connected to LED exposure head 3, toner image forming unit power supply 31 configured to supply a drive voltage to toner image forming unit 4, motor power supply 32 configured to supply a motor drive voltage, heater power supply 34 configured to supply a heating voltage to fixing unit 10, belt thermistor 13, serving as a temperature detector, configured to detect the temperature of fixing unit 10, and the like.

Motor power supply 32 is connected to medium convey motor 33. Medium convey motor 33 is provided in sheet convey unit 2 for conveying paper sheet 1. Medium convey motor 33 is activated to rotate by the motor driving voltage supplied from motor power supply 32 so as to drive sheet convey unit 2. Fixing unit 10 is connected to heater power supply 34. Fixing unit 10 includes: fixing belt 11, which serves as a fixing member or a heat transfer member, configured to be in contact with paper sheet 1 as it moves in the conveyed direction; fixing heater 12, which serves as a heater, configured to heat the entire width of fixing belt 11 so as to heat paper sheet 1 via fixing belt 11; belt thermistor 13 configured to detect the temperature of the widthwise center of fixing belt 11; and the like.

Print controller 20 includes: heat controller 21 configured to control heater power supply 34 based on the detected temperature of belt thermistor 13 in order to heat fixing belt 11 to a target temperature; temperature setting unit 22 configured to set the target temperature depending on the result of a comparison in which the temperature detected by belt thermistor 13 is compared with a threshold; and the like. Temperature setting unit 22 has therein correction unit 22*a* configured to correct a default target temperature based on the difference between the default target temperature and the temperature detected by belt thermistor 13 when the heater 12 starts to heat.

Figure 1B:
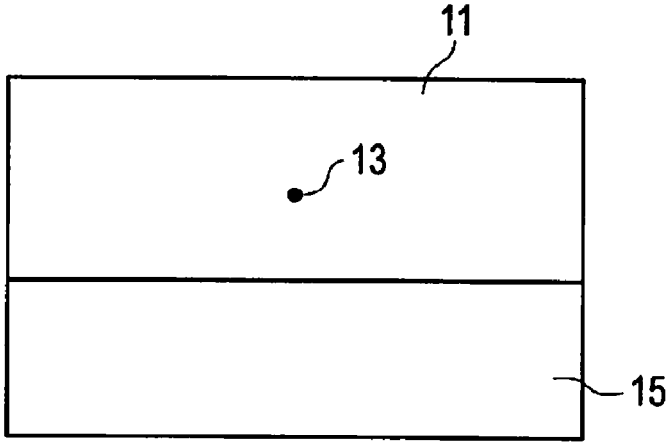

FIGS. 1A and 1B are diagrams of fixing unit 10 shown in FIG. 2 according to the first embodiment of the invention, wherein FIG. 1A is a cross sectional side view of fixing unit 10, and FIG. 1B is a front view of fixing unit 10.

Fixing unit 10 includes fixing rollers (for example, a pair of upper pressure roller 14 and lower pressure roller 15 being in press contact with each other) configured to press there-between paper sheet 1 having toner image 4*a* thereon while allowing the paper sheet 1 to move there-between, and heater supporting member 16 spaced away from and opposed to upper pressure roller 14 and supporting fixing heater 12. Endless fixing belt 11 is supported by and extends around upper pressure roller 14, heater supporting member 16, and fixing heater 12. Fixing belt 11 transfers the heat from fixing heater 12 to paper sheet 1 while conveying paper sheet 1. Belt thermistor 13 detects the temperature of the widthwise center of fixing belt 11. Belt thermistor 13 is disposed in contact with the outer surface of fixing belt 11 at the widthwise center of fixing belt 11 in this embodiment. However, belt thermistor 13 may be disposed in contact with the inner surface of the fixing belt 11 at the widthwise center of fixing belt 11, or may be disposed facing and out of contact with either inner or outer surfaces of the fixing belt 11 at the widthwise center of fixing belt 11.

Upper pressure roller 14 includes metal core 14*a*, which is an iron solid shaft, having an outer diameter of 40 mm, and elastic layer 14*b* made of porous sponge having a thickness of 4 mm and coated on core 14*a*. Upper pressure roller 14 has a gear which is driven to rotate by sheet convey unit 2 and rotates lower pressure roller 15 therewith.

Lower pressure roller 15 is opposed to upper pressure roller 14 such that fixing belt 11 is provided between lower pressure roller 15 and upper pressure roller 14. Lower pressure roller 15 is biased toward upper pressure roller 14 by an un-illustrated elastic member such as a spring. Lower pressure roller 15 is pressed against upper pressure roller 14 via fixing belt 11. A nip is defined between lower pressure roller 15 and upper pressure roller 14 contacting with each other via fixing belt 11.

Fixing belt 11 has a low heat capacity thereby having good thermal responsiveness. Fixing belt 11 includes, for example, a base made of 100 μm thickness high heat-resistant polyimide resin and a release layer made of 200 μm thickness silicon rubber on the surface of the polyimide resin. The base may be made of metal such as stainless-steel or nickel, or of rubber.

Belt thermistor 13 is an element whose resistance changes depending on its temperature. Print controller 20 detects the resistance of belt thermistor 13 and calculates the temperature of belt thermistor 13. In the first embodiment, the resistance of belt thermistor 13 decreases as the temperature of belt thermistor 13 increases.

Figure 4A:
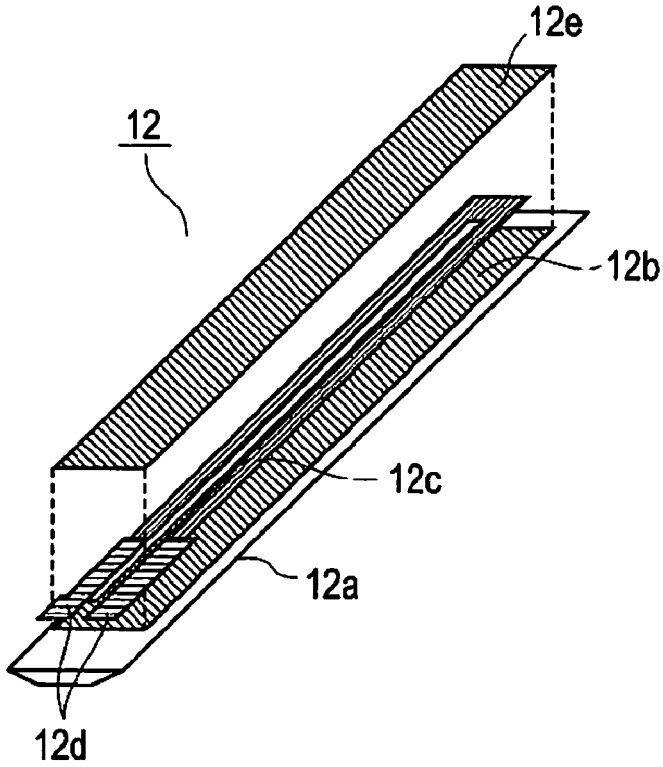
FIGS. 4A and 4B are diagrams of fixing heater 12 shown in FIG. 1.
Figure 4B:
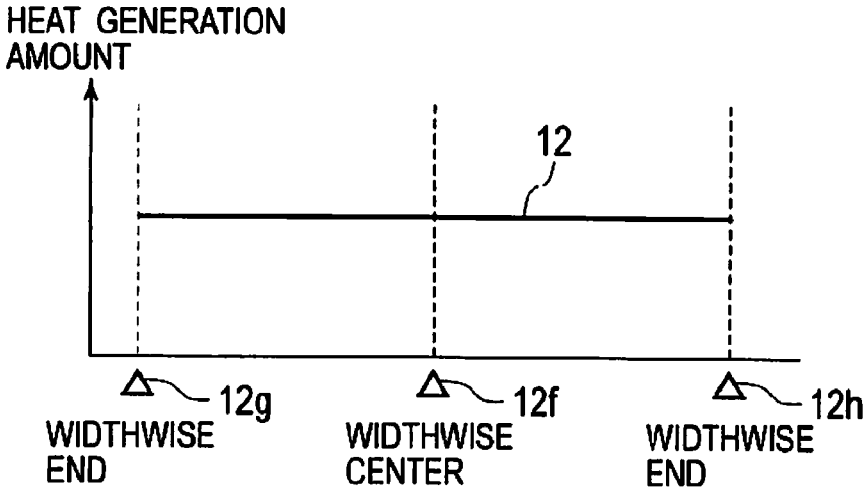

FIGS. 4A and 4B are diagrams showing fixing heater 12 shown in FIG. 1. FIG. 4A is an exploded perspective view of fixing heater 12. FIG. 4B shows the amount of heat generation of fixing heater 12 at positions along the widthwise direction of fixing heater 12.

As shown in FIG. 4A, fixing heater 12 is a sheet heating element extending along the width direction of fixing belt 11, which is a direction orthogonal to the medium conveying direction. Fixing heater 12 includes strip-shaped base plate 12*a*. Strip-shaped electric insulating layer 12*b*, U-shaped resistance heating element 12*c*, electrodes 12*d* formed at the ends of resistance heating element 12*c*, and strip-shaped protective layer 12*e* are layered in that order on base plate 12*a*.

An example of fixing heater 12 has the following configuration. Electric insulating layer 12*b* is made of a thin glass membrane and is formed on base plate 12*a* made of stainless steel (SUS430), for example. Resistance heating element 12*c* is made of nickel-chromium alloy powder or silver-palladium alloy powder and is applied on electric insulating layer 12*b* in a paste form by using screen printing. Electrodes 12*d* are made of a chemically-stable metal having a low electric resistance such as silver, or a high melting point metal such as tungsten, and formed at both ends of resistance heating element 12*c*. The entire surface including base plate 12*a*, electric insulating layer 12*b*, resistance heating element 12*c*, and electrodes 12*d* is covered and protected by protective layer 12*e*. Protective layer 12*e* is made of glass or typical fluorine containing resin such as PTFE (polytetrafluoroethylene), PFA (perfluoro-alkoxyalkane), FEP (Fluorinated ethylene propylene copolymer).

As shown in FIG. 4B, the heat generation amounts of fixing heater 12 remain the same at any positions along the longitudinal direction of fixing heater 12. That is, the heat generation amounts of fixing heater 12 are constant from the longitudinal center 12*f* to the longitudinal ends 12*g* and 12*h*. Electrodes 12*d* of fixing heater 12 are connected to heater power supply 34 shown in FIG. 3 and generate heat when power supply 34 applies voltage to fixing heater 12. The voltage of power supply 34 is, for example, 100V, and the output power of fixing heater 12 is, for example, 1200 W.

Operation of the First Embodiment

The following describes (i) the outline operation of the image forming apparatus of the first embodiment, (ii) the operation of fixing unit 10, and (iii) the temperature control operation for fixing unit 10.

(i) Outline Operation of the Image Forming Apparatus

In the image forming apparatus shown in FIG. 2 and FIG. 3, when print controller 20 of the image forming apparatus receives a print instruction from the image forming apparatus body, sheet convey unit 2 feeds paper sheet 1 to toner image forming unit 4 in synchronization with the toner image forming process of toner image forming unit 4. LED exposure head 3 emits recording light according to the print instruction information to toner image forming unit 4, and toner image forming unit 4 forms toner image 4*a* according to the recording light on paper sheet 1. Paper sheet 1 having toner image 4*a* thereon is conveyed to fixing unit 10 by sheet convey unit 2. In fixing unit 4, toner image 4*a* is fixed onto paper sheet 1 by the pressure and the heat of fixing unit 10. Paper sheet 1 having the fixed toner image 4*a* is then discharged out of the image forming apparatus.

(ii) Operation of Fixing Unit 10

In the image forming apparatus shown in FIGS. 1 to 4, when print controller 20 receives the print instruction from the image forming apparatus body, print controller 20 drives sheet convey unit 2 to rotate lower pressure roller 15 via an un-illustrated gear. Further, heat controller 21 in print controller 20 determines whether the temperature of fixing unit 10 detected by belt thermistor 13 is in a predetermined printable temperature range, and then print controller 20 starts the conveyance of paper sheet 1 when the detected temperature is within the range.

The printable temperature range is that in which toner is able to fused and fixed on paper sheet 1. The printable temperature has a lower limit temperature T1 (for example, 175 C) and an upper limit temperature T2 (for example, 205 C). When the detected temperature is greater than upper limit temperature T2, heat controller 21 executes a cool down by stopping the supply of power from heater power supply 34 to fixing heater 12, thereby lowering the temperature of fixing belt 11. On the other hand, when the detected temperature is less than lower limit temperature T1, heat controller 21 executes a warm-up by supplying the power from heater power supply 34 to fixing heater 12, thereby increasing the temperature of fixing belt 1.

Figure 5A:
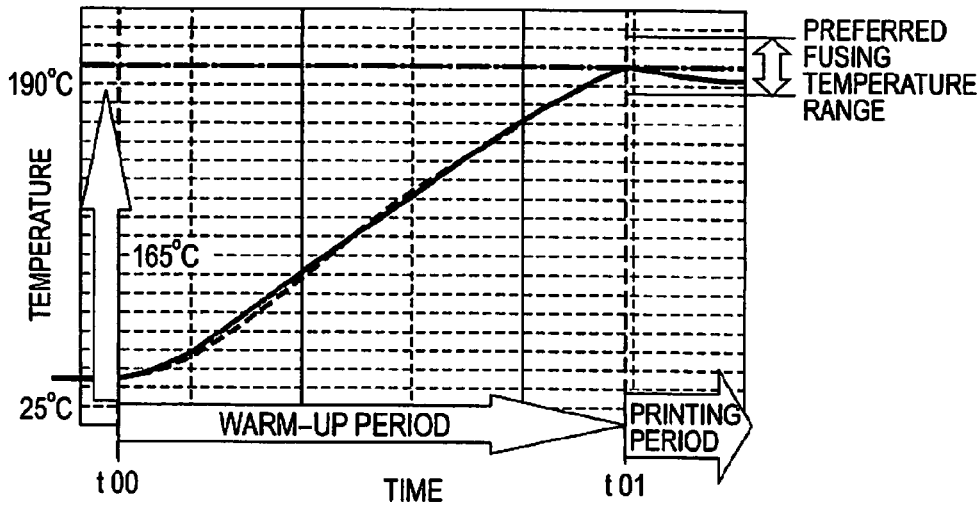
FIGS. 5A and 5B show temperature-time curves of fixing belt 11 before, during, and after a warm-up operation in which fixing belt 11 is heated by fixing heater 12. A warm-up start temperature difference in FIG. 5A is different from that in FIG. 5B. The warm-up start temperature difference is the difference between the temperature of the widthwise center of fixing belt 11 at the beginning of the warm-up operation and a default target temperature of the widthwise center of fixing belt 11.
Figure 5B:
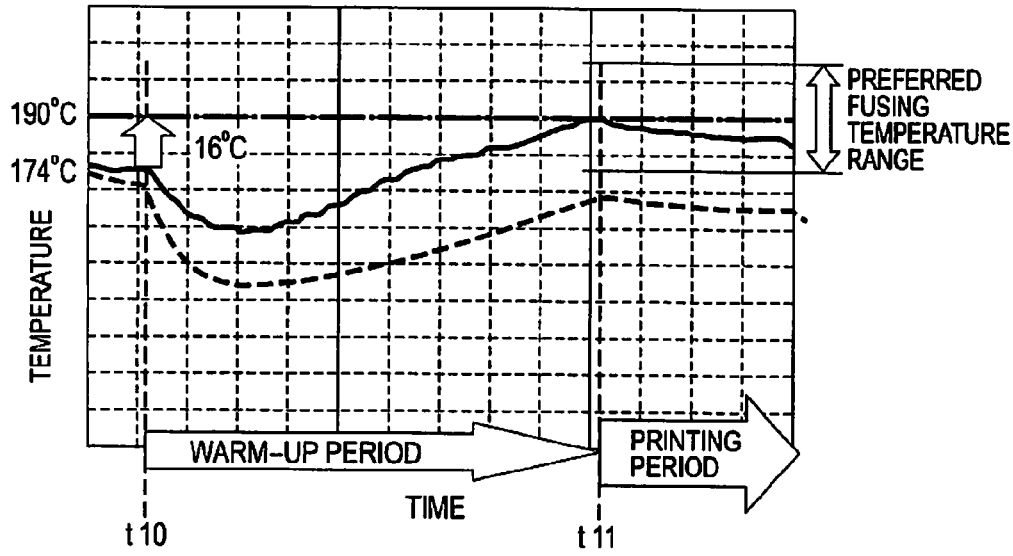

FIGS. 5A and 5B shows temperature-time curves of fixing belt 11 before, during, and after the warm-up operation in which fixing belt 11 is heated by fixing heater 12.

In FIGS. 5A and 5B, the solid lines designate temperatures of the widthwise center of fixing belt 11, and the broken lines designate temperatures of the widthwise end of fixing belt 11. Note that the warm-up start temperature at the widthwise center of fixing belt 11 in FIG. 5A is different from that in FIG. 5B. In other words, the warm-up start temperature difference, which is the difference between the warm-up start temperature of the widthwise center of fixing belt 11 and the default target temperature of the widthwise center of fixing belt 11, is different from that in FIG. 5B.

FIG. 5A shows temperature-time curves of fixing belt 11, wherein fixing heater 12 is turned on to start heating the fixing belt 11 at time t00, when the temperatures of all components of fixing unit 10 (including the temperature of the widthwise center and the temperature of the widthwise end of fixing belt 11) are the room temperature of 25 C, and fixing heater 12 keeps heating during warm-up operation (from time t00 to time t01), and then fixing heater 12 is turned off to start the printing operation at time t01, when the temperature of the widthwise center of fixing belt 11 comes to be the target temperature of 190 C.

Although room temperature is 25 C in this specification, the room temperature is not limited to 25 C. The widthwise center and the widthwise end of fixing belt 11 have the same temperature as room temperature, after an adequate length of time (for example, more than 2 or 3 hours) has elapsed without heating.

FIG. 5B shows temperature-time curves of fixing belt 11, wherein fixing heater 12 is turned on to start heating the fixing belt 11 at time t10, when the widthwise center of fixing belt 11 has a temperature (174 C in this example) near the target temperature of 190 C, and fixing heater 12 keeps heating during the warm-up operation period (from time t10 to time t11), and then, fixing heater 12 is turned off to start the printing operation at time t11, when the widthwise center of fixing belt 11 comes to be the target temperature of 190 C.

Note that the state of fixing belt 11 at time t10, which includes the temperature of the widthwise center of fixing belt 11 and the temperature of the widthwise end of fixing belt 11, depends on the characteristic of fixing unit 10 (such as the heat capacity of components of fixing unit 10, the output power of fixing heater 12, the heating distribution of fixing heater 12, and the like), and the operation history (such as a warm-up operation period before time t10, a print amount before time t10, a lapsed time from the prior warm-up operation). At time t10, the temperature of the widthwise center of fixing belt 11 is greater than the temperature of the widthwise end of fixing belt 11. According to fixing unit 10 that has a characteristic in which the widthwise end of fixing belt 11 and the widthwise center of fixing belt 11 have the same temperature at time t01 as in FIG. 5A, the temperature of the widthwise end of fixing belt 11 will be less than that of the widthwise center of fixing belt 11 at time t10, which is a time after a warm-up operation and a printing operation. The characteristic of fixing unit 10 is determined by the structure of fixing unit 10 (such as the radiation amount of heater supporting member 16), and the heating distribution of fixing heater 12 as shown in FIGS. 4A and 4B, and the like.

As shown in FIGS. 5A and 5B, the temperature difference between the widthwise center and the widthwise end of fixing belt 11 at the warm-up end (t01, t11) varies depending on the warm-up start temperature difference at the warm-up start (t00, t10).

As shown in FIG. 5A, when the total heating amount applied to fixing belt 11 from fixing heater 12 during the warm-up operation is large, the total heating amount is much larger than the heat that is radiated from the widthwise end of fixing belt 11 to a chassis or the like. Further, during the warm-up operation, the temperatures of the widthwise ends of heater supporting member 16 are low and are equal to those of the widthwise center. On the other hand, the heat amount of fixing heater 12 at the widthwise end of fixing belt 11 is equal to that at the widthwise center of fixing belt 11. Therefore, at the warm-up end (time t01), the widthwise center temperature of fixing belt 11 is equal to the widthwise end temperature of fixing belt 11.

In contrast, as shown in FIG. 5B, when the total heating amount applied to fixing belt 11 from fixing heater 12 during a warm-up operation is small, heat that is radiated from the widthwise ends of fixing belt 11 to the chassis or the like is relatively large compared to the total heating amount. The temperatures of the widthwise end of fixing belt 11 and heater supporting member 16 are thus much lower than the widthwise center of fixing belt 11 and heater supporting member 16 at the warm-up end. Accordingly, at the warm-up end (time t11), the temperature of the widthwise end of fixing belt 11 is less than the widthwise center of fixing belt 11.

As described above, there is a correlation between the heating amount applied to fixing belt 11 during the warm-up operation and the difference between the widthwise center temperature and the widthwise end temperature of fixing belt 11 at the end of the warm-up operation (time t01, t11).

The heating amount applied to fixing belt 11 is proportional to the warm-up operation period, during which fixing heater 12 heats fixing belt 11, since the heat output of fixing heater 12 is constant. Further, since the heat output of fixing heater 12 is constant and the increased temperature per unit time is constant, the warm-up operation period, during which fixing heater 12 heats fixing belt 11, is proportional to the warm-up start temperature difference, which is the difference between the temperature of the widthwise center of fixing belt 11 at the warm-up start time and the target temperature.

Accordingly, the warm-up start temperature difference at the warm-up start (t00, t10) correlates with the temperatures (the widthwise center temperature and the widthwise end temperature) at the warm-up end (t01, t11).

Figure 6:
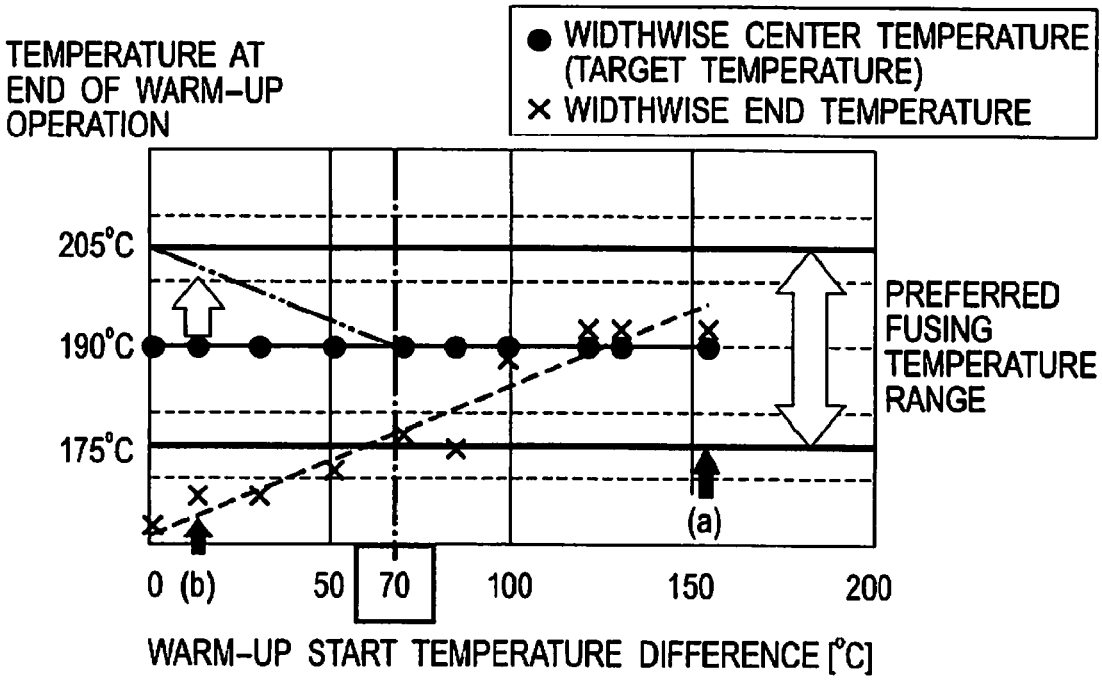
FIG. 6 shows a relationship between the warm-up start temperature difference and the temperatures (the widthwise center temperature and the widthwise end temperature) of fixing belt 11 at the end of the warm-up operation.

FIG. 6 is shows the relationship between the warm-up start temperature difference and the temperatures (the widthwise center temperature and the widthwise end temperature) of fixing belt 11 at the end of the warm-up operation. FIG. 6 shows a correlation between the widthwise center temperature and the widthwise end temperature of fixing belt 11 at the end of the warm-up operation. Black solid circles in FIG. 6 designate the widthwise center temperatures at the end of the warm-up operation, which are the target temperature of the widthwise center. X-marks in FIG. 6 designate the temperatures of the widthwise end of fixing belt 11 at the end of the warm-up operation.

As shown in FIG. 6, the temperature of the widthwise end of fixing belt 11 at the end of the warm-up operation is proportional to the warm-up start temperature difference, which is the difference between the target temperature of the widthwise center of fixing belt 11 and the temperature of the widthwise center of fixing belt 11 at the start of the warm-up operation. If the warm-up start temperature difference is large, that is, if the temperature of fixing belt 11 at the warm-up start time is low, the widthwise center and the widthwise end of fixing belt 11 are both heated adequately during the warm-up operation, and thus the widthwise center temperature and the widthwise end temperature at the end of the warm-up operation have no or little difference from each other. Therefore, the widthwise end temperature as well as the widthwise center temperature falls in a preferred fusing temperature range (or printable temperature range). In contrast, if the warm-up start temperature difference is small, that is, if the temperature of fixing belt 11 at the warm-up start time is high, the widthwise ends of fixing belt 11 is not heated adequately when the widthwise center reaches the target temperature, and thus the widthwise center temperature at the end of the warm-up does not reach the preferred fusing temperature range (or the printable temperature range). Therefore, the widthwise end of fixing belt 11 does not supply adequate heat to paper sheet 1, and this might cause inadequate fixing of the toner at an area on paper sheet 1 corresponding to the widthwise end of fixing belt 11.

In order to overcome the above described problem, that is, in order to heat the widthwise end of fixing belt 11 as well as the widthwise center to the preferred fusing temperature range (or the printable temperature range) at the end of the warm-up operation, the first embodiment shown in FIG. 3 has temperature setting unit 22 having therein correction unit 22*a*, which corrects a default target temperature depending on the warm-up start temperature difference to a target temperature higher than the default target temperature. Correction unit 22*a* in this embodiment corrects the default target temperature only in required conditions, that is, only if the warm-up start temperature difference is less than threshold temperature Tth_low. Therefore, the widthwise end temperature is controlled into the preferred fusing temperature range, regardless of the warm-up start temperature difference. Note that threshold temperature Tth_low is the upper limit of a range, in the warm-up start temperature difference, where the default target temperature needs to be corrected. Threshold temperature Tth_low is 70 C in the first embodiment as shown in FIG. 6. Correction value Tcomp used for correcting the default target temperature is derived from the relationship between the warm-up start temperature difference and the widthwise end temperature at the end of the warm-up operation shown in FIG. 6 and is expressed by the following formula (1).

$$Tcomp = A \times \Delta T + B \quad (1)$$

Tcomp: correction value

A, B: constant

ΔT: warm-up start temperature difference

Constants A and B in the formula (1) are derived from experiment, and constant A is $-15/70$ and constant B is 15 in this embodiment, as shown in FIG. 6.

In the case where a warm-up operation starts in the same condition as in FIG. 5B, where the default target temperature of the widthwise center is 190 C and the warm-up start temperature of the widthwise center is 175 C, warm-up start temperature difference ΔT is 15 C, which is small. The calculated warm-up start temperature difference ΔT of 15 C is less than threshold temperature Tth_low of 70 C, and the correction of the default target temperature is processed. Accordingly, correction unit 22*a* corrects the default target temperature to the target temperature by adding 12 C to the default target temperature, since correction value Tcomp is 12 C calculated by the following formula.

$$Tcomp=-\frac{15}{70}\times 15+15=12\ C.$$

In the case where a warm-up operation starts in the same condition as in FIG. 5A, where the target temperature of the widthwise center is 190 C and the warm-up start temperature of the widthwise center is 25 C, warm-up start temperature difference ΔT is 165 C, which is large. The calculated warm-up start temperature difference ΔT of 165 C is greater than threshold temperature Tth_low of 70 C, and thus the correction of the default target temperature is not executed. Accordingly, the default target temperature of 190 C is not corrected and is set as the target temperature.

(iii) Temperature Control Operation of Fixing Unit 10

Figure 7:
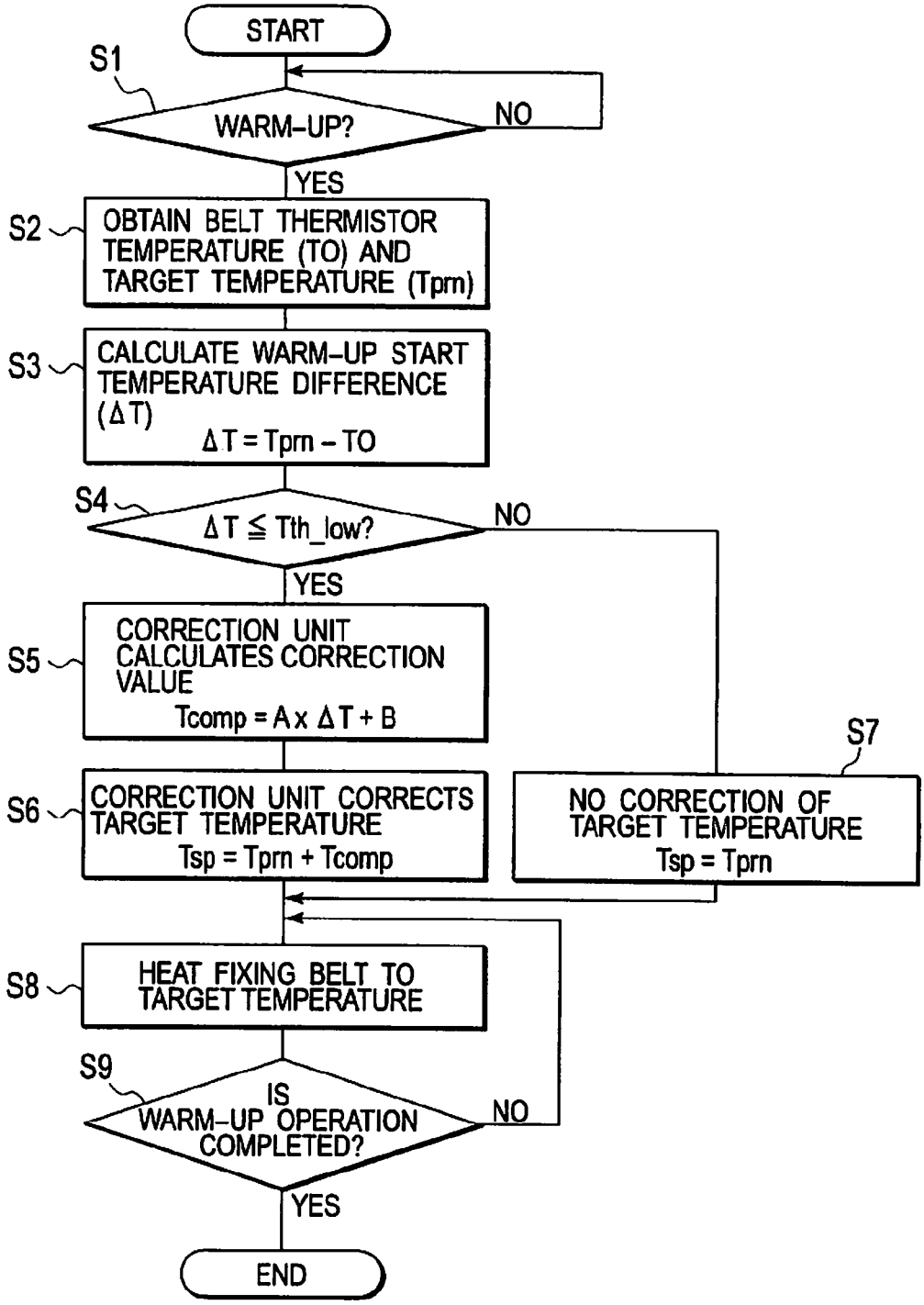
FIG. 7 is a flow chart showing a temperature control operation for fixing unit 10 shown in FIG. 1.

FIG. 7 is a flow chart showing the temperature control operation of fixing unit 10 shown in FIG. 1.

Print controller 20 executes the following steps S1 to S9 for fixing unit 10.

After starting to operate fixing unit 10, print controller 20 detects whether a warm-up operation occurs or not in step S1, and proceeds to step S2 when the warm-up operation occurs (Y). In step S2, print controller 20 obtains temperature T0 detected by belt thermistor 13 and default target temperature Tprn, before starting heat control of fixing heater 12. Correction unit 22*a* calculates warm-up start temperature difference ΔT (ΔT=Tprn−T0) in step S3 and compares warm-up start temperature difference ΔT with threshold temperature Tth_low in step S4.

When the comparison result in step S4 shows that warm-up start temperature difference ΔT is equal or less than threshold temperature Tth_low (Y), correction unit 22*a* calculates the correction value Tcomp (Tcomp=A×ΔT+B) in step S5 and corrects the default target temperature Tprn to a target temperature Tsp (Tsp=Tprn+Tcomp) in step S6, and proceeds to step S8. When the comparison result in step S4 shows that warm-up start temperature difference ΔT is greater than threshold temperature Tth_low (ΔT>Tth_low), correction unit 22*a* does not execute the correction of the default target temperature Tprn and sets the default target temperature Tprn as the target temperature Tsp (Tsp=Tprn) in step S7, and proceeds to step 8.

In step S8, heat controller 21 turns on fixing heater 12 in order to heat fixing belt 11 to target temperature Tsp, and proceeds to step S9. In step S9, print controller 20 determines whether the widthwise center temperature of fixing belt 11, which is the temperature detected by belt thermistor 13, reaches target temperature Tsp, and turns off the fixing heater 12 to end the warm-up operation if the widthwise center temperature reaches the target temperature Tsp, and the temperature control operation for fixing unit 10 is thus ended.

After that, print controller 20 executes the printing operation when printer controller 20 receives a print instruction from the image forming apparatus body, or proceeds to waiting operation when print controller 20 does not receive the print instruction.

Effects of the First Embodiment

Figure 8A:
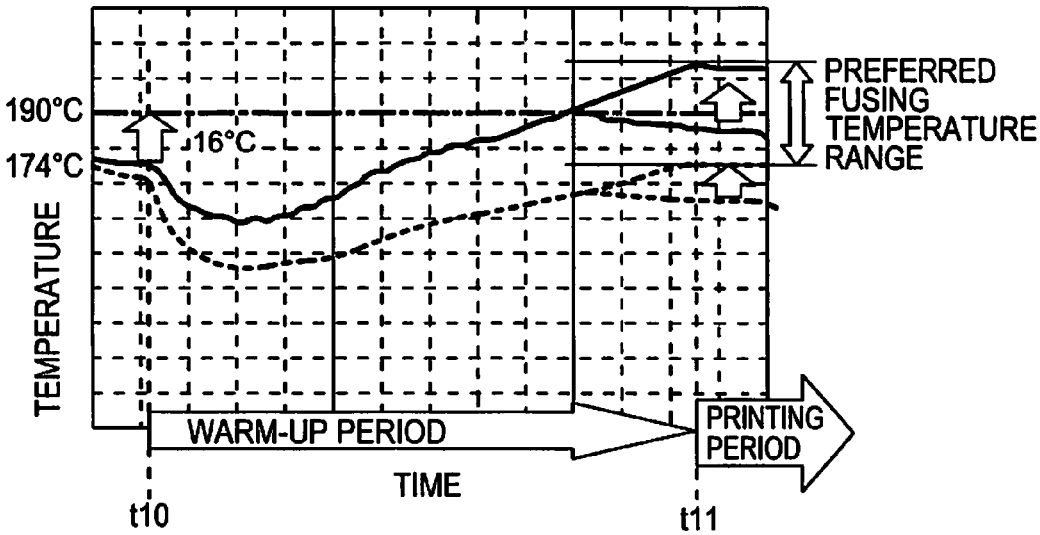
FIGS. 8A and 8B show effects caused by the temperature control operation for fixing unit 10 shown in FIG. 1.
Figure 8B:
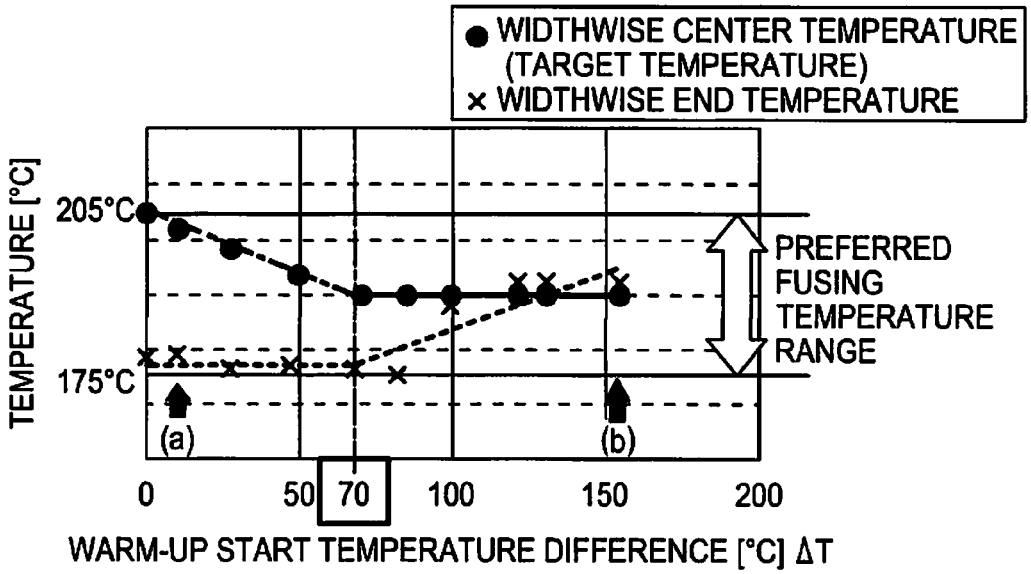

FIGS. 8A and 8B show the effects of the heat control for fixing unit 10 of FIG. 1. FIG. 8A corresponds to FIG. 5B, and FIG. 8B corresponds to FIG. 6.

Since the first embodiment executes the above described heat control operation, the widthwise center temperature and the widthwise end temperature of fixing belt 11 fall in the preferred fusing temperature range regardless of the value of the warm-up start temperature difference as shown in FIGS. 8A and 8B, even in the condition when the widthwise end of fixing belt 11 is below the preferred fusing temperature range after the conventional warm-up operation as shown in FIG. 5B.

Accordingly, the first embodiment uses one fixing heater 12 and one belt thermistor 13 and corrects the default target temperature to the target temperature, depending on the warm-up start temperature difference, which is the difference between the temperature of the widthwise center of fixing belt 11 at the warm-up start time and the default target temperature of the widthwise center of fixing belt 11. The first embodiment thus can heat the entire width of fixing belt 11 to be within the preferred fusing temperature range and prevents printing failure with a simple structure and a simple control. Therefore, the first embodiment prevents printing failure with belt thermistor 13 provided at the widthwise center of fixing belt 11 without additional temperature detectors, thereby decreasing the number of components of the image forming apparatus.

Second Embodiment

Configuration of the Second Embodiment

An image forming apparatus of the second embodiment of the invention has the same outline structure as that of the image forming apparatus of the first embodiment shown in FIG. 2.

Figure 9:
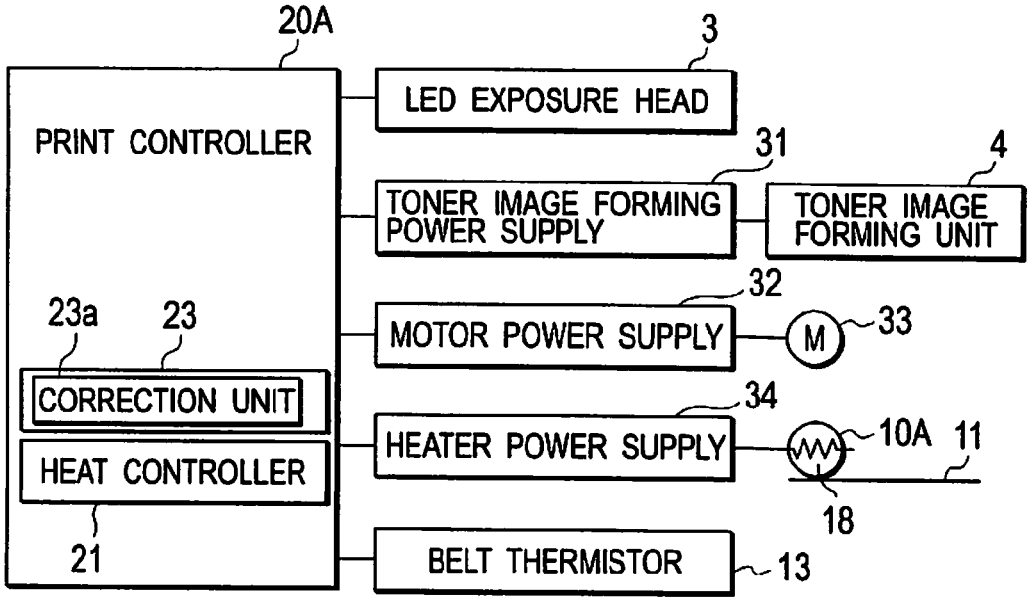
FIG. 9 is a block diagram of a configuration of a control device for controlling an image forming apparatus shown in FIG. 2 according to a second embodiment of the invention.

FIG. 9 is a block diagram of a configuration of a control device for controlling the image forming apparatus of FIG. 2 according to the second embodiment of the invention. In the second embodiment, the configurations that are the same as those in FIG. 2 of the first embodiment are designated by the same reference numerals.

The second embodiment includes fixing unit 10A and print controller 20A that have different structures or different functions from fixing unit 10 and print controller 20 of the first embodiment.

Fixing unit 10A is connected to print controller 20A via heater power supply 34 that is the same as that of the first embodiment. Fixing unit 10A includes: fixing belt 11 that is the same as that of the first embodiment; fixing heater 18 that has a different structure from fixing heater 12 of the first embodiment and heats fixing belt 11; belt thermistor 13 that is the same as that of the first embodiment; and the like.

Print controller 20A includes a CPU that is configured to control printing operation. Like the first embodiment, print controller 20A includes: heat controller 21 configured to control heater power supply 34 for heating fixing belt 11 to the target temperature based on the temperature detected by belt thermistor 13; temperature setting unit 23 that has different functions from temperature setting unit 22 of the first embodiment and that compares the temperature detected by belt thermistor 13 with a threshold temperature or a threshold and sets the target temperature based on the comparison result. Temperature setting unit 23 has therein correction unit 23*a* that corrects the default target temperature based on a difference between the temperature detected by belt thermistor 13 at the warm-up start time and the default target temperature.

Figure 10A:
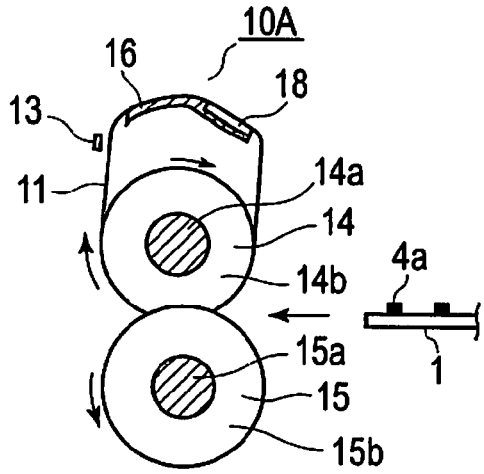
FIGS. 10A, 10B and 10C are diagrams of fixing unit 10A shown in FIG. 9 according to the second embodiment of the invention.
Figure 10B:
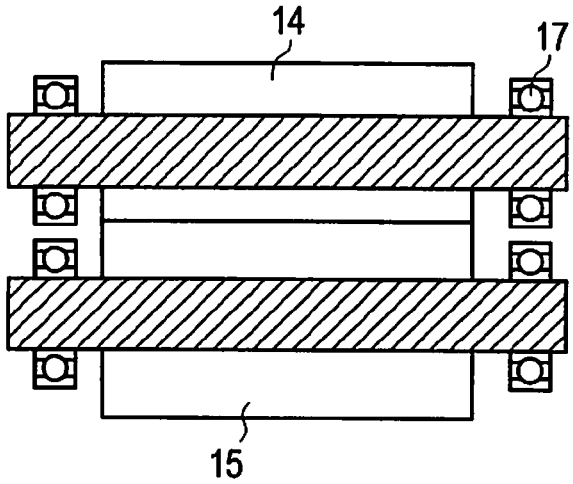
Figure 10C:
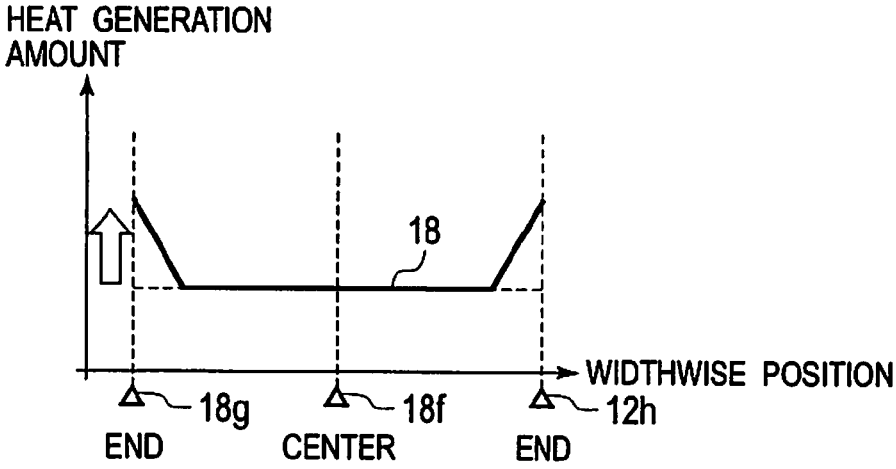

Other configurations of the control device are the same as that of the first embodiment. FIGS. 10A to 10C show diagrams of fixing unit 10A of the second embodiment shown in FIG. 9. FIG. 10A is a sectional side view of fixing unit 10A, FIG. 10B is a sectional front view of fixing unit 10A, and FIG. 10C shows the amount of heat generation of fixing heater 12 at positions along the widthwise direction of fixing heater 18 shown in FIG. 10A. In FIGS. 10A to 10C, the same structures as those of the first embodiment shown in FIGS. 1A, 1B, and 4B are designated by the same reference numerals.

Fixing unit 10A shown in FIGS. 10A and 10B includes fixing rollers (for example, a pair of upper pressure roller 14 and lower pressure roller 15) configured to press against each other thereby functioning the same as or similar to that of the first embodiment, heater supporting member 16 that is the same as or similar to that of the first embodiment and spaced from and opposed to upper pressure roller 14 and supporting fixing heater 18. Endless fixing belt 11 has the same as or similar structure as that of the first embodiment and is supported by and extends around upper pressure roller 14, heater supporting member 16, and fixing heater 18. Fixing belt 11 transfers heat from fixing heater 18 to paper sheet 1 while conveying paper sheet 1. Belt thermistor 13 has the same or similar structure as that of the first embodiment and is disposed to detects the temperature of the surface of the widthwise center of fixing belt 11.

Upper pressure roller 14 and lower pressure roller 15 of fixing unit 10A are supported by supporting members 17 or bearings. Upper pressure roller 14 and lower pressure roller 15 are opposed to each other and sandwich fixing belt 11 there-between. Axial ends of upper pressure roller 14 and lower pressure roller 15 are rotatably supported by supporting members 17, such that paper sheet 1 that is conveyed on fixing belt 11 can run between upper pressure roller 14 and lower pressure roller 15.

Supporting member 17 is made of metal or the like and has a large volume of sufficient strength for supporting upper pressure roller 14 and lower pressure roller 15, thereby having a large heat capacity. Therefore, the rate of increase of the temperature of supporting member 17 is less than that of fixing belt 11. Even if heater 18 starts to heat fixing belt 11 in a condition where the fixing belt 11 and the supporting member 17 have the same temperature, the temperature increase of supporting member 17 is much smaller than that of fixing belt 11 after the warm-up of fixing belt 11 is completed. In such a structure of fixing unit 10A, heat is lost to supporting members 17 from fixing belt 11 through the axial ends of rollers 14 and 15 where supporting members 17 contact. The axial ends of pressure rollers 14 and 15 have a lower temperature, and the widthwise ends of fixing belt 11 that are in contact with the axial ends of pressure rollers 14 and 15 thus have a lower temperature and cannot supply enough heat to paper sheet 1, thereby causing a fusing failure. To prevent the decrease in temperature of the widthwise ends of fixing belt 11 without adding other heaters to fixing heater 18, fixing heater needs to have a feature such that the widthwise ends of fixing heater 18 have a higher heat generation amount than the widthwise center of fixing heater 18.

The second embodiment uses fixing heater 18 replacing fixing heater 12 of the first embodiment. Fixing heater 18 has widthwise ends 18*g* and 18*h* generating more heat amount than the widthwise center 18*f* as shown in FIG. 10C. Fixing heater 18 of the second embodiment has a structure similar to fixing heater 12 of the first embodiment shown in FIG. 4A, but resistance heating element 12*c* of fixing heater 18 in the second embodiment is different from that in the first embodiment. Resistance heating element 12*c* is provided on electric insulating layer 12*b* on base plate 12*a* and extends along the widthwise direction of the fixing belt 11, as in the first embodiment, but has a longitudinal end being wider than the longitudinal center in the second embodiment. In a case where resistance heating element 12*c* is applied on electric insulating layer 12*b* in a paste form by using a screen printing, it is easy to make the applied area of resistance heating element 12*c* at the longitudinal end smaller than that of the longitudinal center to adjust the heat distribution of resistance heating element 12*c*.

Operation of the Second Embodiment

The general operation of the image forming apparatus of the second embodiment is the same as that of the first embodiment. Next, (I) the operation of fixing unit 10A and (II) the heat control operation of fixing unit 10A different from those of the first embodiment will be described.

(I) Operation of Fixing Unit 10A in FIG. 9 and FIG. 10

As in the first embodiment, upon receiving a print instruction from the image forming apparatus body, print controller 20A instructs sheet convey unit 2 in FIG. 2 to rotate lower pressure roller 15 via un-illustrated gears. Heat controller 21 provided in print controller 20A determines whether the temperature detected by belt thermistor 13 in fixing unit 10A is within the predetermined printable temperature range. If the detected temperature is within the printable temperature range, print controller 20A instructs sheet convey unit 2 to start conveying paper sheet 1.

As in the first embodiment, the printable temperature range is a range of temperature in which toner is able to be fused and fixed on paper sheet 1, and whose lower limit temperature T1 is, for example, 175 C and whose upper limit temperature T2 is, for example, 205 C. If the detected temperature is above upper limit temperature T2, heat controller 21 executes a cool down operation by stopping the supply of power from heater power supply 34 to fixing heater 18, thereby lowering the temperature of fixing belt 11. On the other hand, when the detected temperature is below lower limit temperature T1, heat controller 21 executes a warm-up operation by supplying power from heater power supply 34 to fixing heater 18, thereby increasing the temperature of fixing belt 1.

Figure 11A:
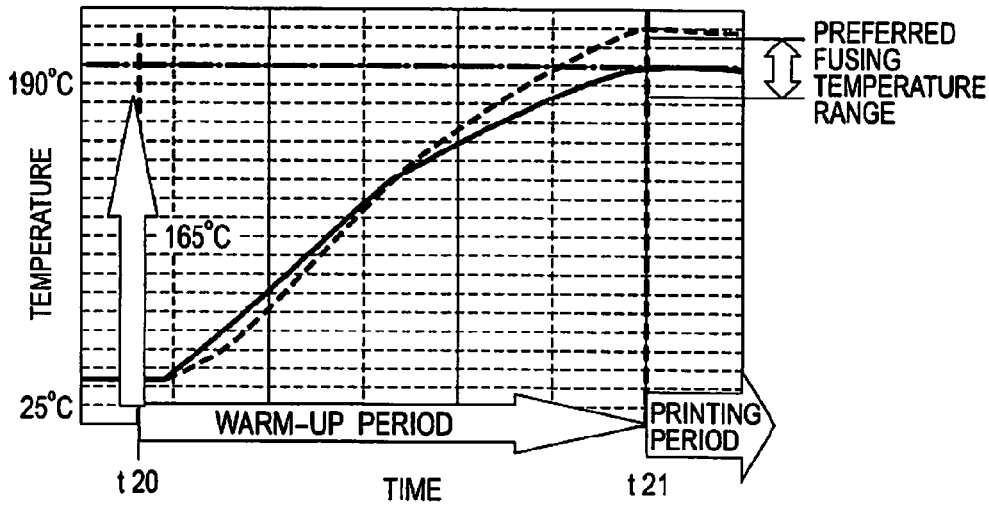
FIGS. 11A and 11B show temperature curves of fixing belt 11 before, during, and after the warm-up operation in which fixing belt 11 is heated by fixing heater 12.
Figure 11B:
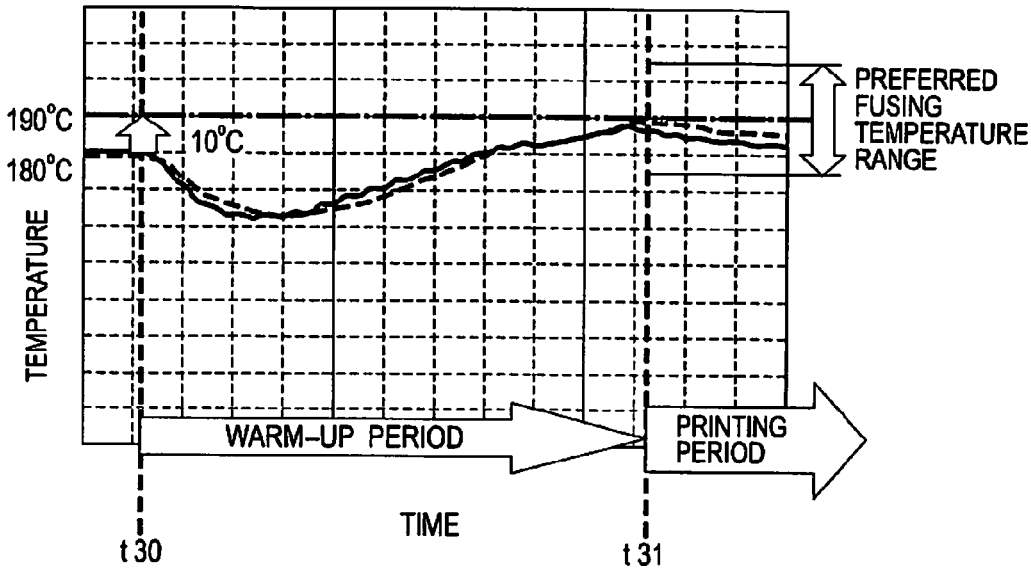

FIGS. 11A and 11B show temperature curves of fixing belt 11. The warm-up start temperature difference in FIG. 11A is different from that in FIG. 11B. FIGS. 11A and 11B in the second embodiment correspond to FIGS. 5A and 5B in the first embodiment.

As in FIGS. 5A and 5B of the first embodiment, FIGS. 11A and 11B of the second embodiment show temperature curves before, during, and after the warm-up operation. In FIGS. 11A and 11B, the solid lines designate temperatures of the widthwise center of fixing belt 11, and broken lines designate temperatures of the widthwise end of fixing belt 11.

FIG. 11A shows temperature-time curves of fixing belt 11 wherein fixing heater 12 is turned on to start heating the fixing belt 11 at time t20, when the widthwise center temperature and the widthwise end temperature of fixing belt 11 are at room temperature of 25 C, and fixing heater 12 keeps heating during the warm-up operation period (from t20 to t21), and then, fixing heater 12 is turned off to start the printing operation at t21, when the temperature of the widthwise center of fixing belt 11 comes to the target temperature of 190 C.

Note that the widthwise end temperature of fixing belt 11 is greater than the widthwise center temperature of fixing belt 11 at time t21, since the heat generation amount of the longitudinal end portions 18*g* and 18*h* of fixing heater 18 is greater than the longitudinal center portion 18*f* of fixing heater 18.

FIG. 11B shows temperature-time curves of fixing belt 11 wherein fixing heater 12 is turned on to start heating the fixing belt 11 at time t30, when the widthwise center of fixing belt 11 has a temperature (180 C in this example) near the target temperature of 190 C, and fixing heater 12 keeps heating during warm-up operation period (from t30 to t31), and then, fixing heater 12 is turned off to start the printing operation, at time t31, when the widthwise center of fixing belt 11 comes to be the target temperature of 190 C.

Note that the state of fixing belt 11 at time t30, which includes the temperature of the widthwise center of fixing belt 11 and temperature of the widthwise end of fixing belt 11, depends on the characteristic of fixing unit 10, and the operation history before time t30. In fixing unit 10 that has the characteristic in which the widthwise end temperature of fixing belt 11 is greater than the widthwise center temperature of fixing belt 11 at time t21 in FIG. 11A, the widthwise end temperature of fixing belt 11 is the same as the widthwise center temperature of fixing belt 11 at time t30, which is the time after the warm-up operation or the printing operation.

As shown in FIGS. 11A and 11B, as in the first embodiment, the temperature difference between the widthwise center and the widthwise end of fixing belt 11 at the warm-up end time (t21, t31) varies depending on the warm-up start temperature difference at the warm-up start time (t00, t10).

Figure 12:
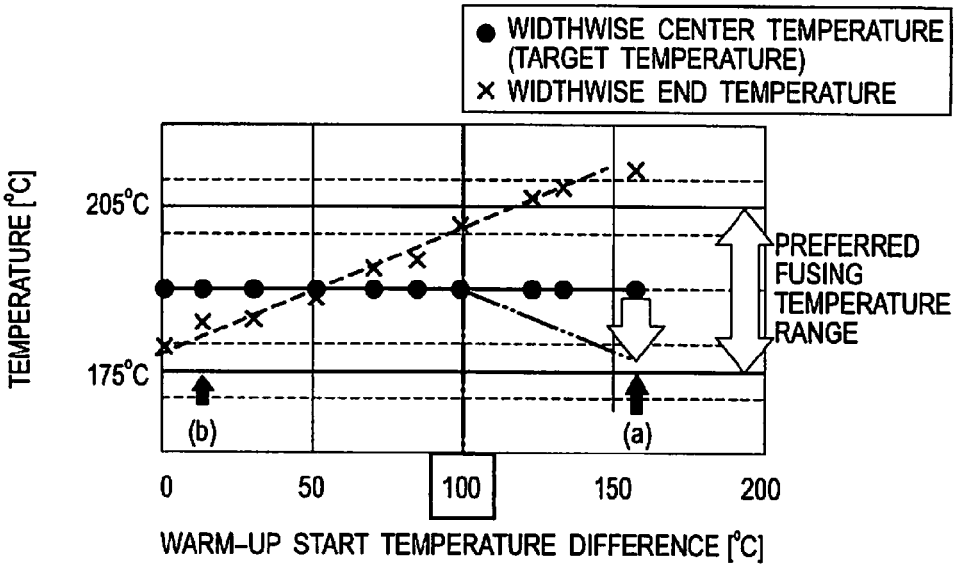
FIG. 12 is a view showing a relationship between the default target temperature and the warm-up start temperature difference of the widthwise center of fixing belt 11 according to the second embodiment.

FIG. 12 shows the relationship between the warm-up start temperature difference at the beginning of the warm-up start operation and the temperature of fixing belt 11 at the end of the warm-up operation.

FIG. 12 corresponds to FIG. 6 in the first embodiment and shows a correlation between the widthwise center temperature and the widthwise end temperature of fixing belt 11 at the end of the warm-up operation. Black solid circles in FIG. 12 designate the widthwise center temperature at the end of the warm-up operation, which is the target temperature of the widthwise center. X-marks in FIG. 12 designate the temperatures of the widthwise end of fixing belt 11 at the end of the warm-up operation.

In the second embodiment, as shown in FIG. 12, there is a correlation between the warm-up start temperature difference and the widthwise end temperature of fixing belt 11 at the end of the warm-up operation. However, the correlation is different from that in the first embodiment and the correlation in the second embodiment shows that in the case where the warm-up start temperature difference is large, the widthwise end temperature of fixing belt 11 is above the preferred fusing temperature range, causing printing failure. This is because the widthwise end portion of fixing heater 18 generates more heat than the widthwise center portion.

To overcome the above problem, the second embodiment has temperature setting unit 23 having correction unit 23*a* which corrects the default target temperature depending on the warm-up start temperature difference to a target temperature lower than the default target temperature. Correction unit 23*a* in this embodiment corrects the target temperature only in required conditions, that is, only if the warm-up start temperature difference is higher than threshold temperature Tth_high, which is a threshold. Therefore, the widthwise end temperature is controlled to the preferred fusing temperature range, regardless of the warm-up start temperature difference.

Note that threshold temperature Tth_high is the lower limit of the range in the warm-up start temperature difference where the default target temperature needs to be corrected. The threshold temperature is 100 C in the second embodiment as shown in FIG. 12. Correction value Tcomp used for correcting the default target temperature is expressed by the following formula (2) which is substantially the same as that in the first embodiment.

$$T\text{comp}=C\times\Delta T+D \quad (2)$$

Tcomp: correction value

C, D: correction coefficient

ΔT: warm-up start temperature difference

Correction coefficients C and D in the formula (2) are derived from experiments and correction coefficient C is $-15/60$ and correction coefficient D is 25 in this second embodiment as shown in FIG. 12.

For example, where a warm-up operation starts in the same condition as in FIG. 11A, warm-up start temperature difference ΔT is large at 165 C, since the warm-up start temperature of the widthwise center is 25 C and the target temperature of the widthwise center is 190 C. The calculated warm-up start temperature difference ΔT of 165 C is greater than threshold temperature Tth_high of 100 C, and thus the correction of the default target temperature is executed. Accordingly, correction unit 23*a* corrects the default target temperature to a target temperature by subtracting 15 C from the default target temperature of 190 C, since correction value Tcomp is 15 C calculated by the following formula.

$$T\text{comp}=-15/60\times 160+25=-15\text{ C}$$

For example, where a warm-up operation starts in the same condition as in FIG. 11B, warm-up start temperature difference ΔT is small at 15 C, since the warm-up start temperature of the widthwise center is 175 C and the target temperature of the widthwise center is 190 C. The calculated warm-up start temperature difference ΔT of 15 C is less than threshold temperature Tth_high of 100 C, and thus the correction of the default target temperature is not executed. Accordingly, the default value of 190 C is not corrected and is set as the target temperature.

(II) Temperature Control Operation of Fixing Unit 10A

Figure 13:
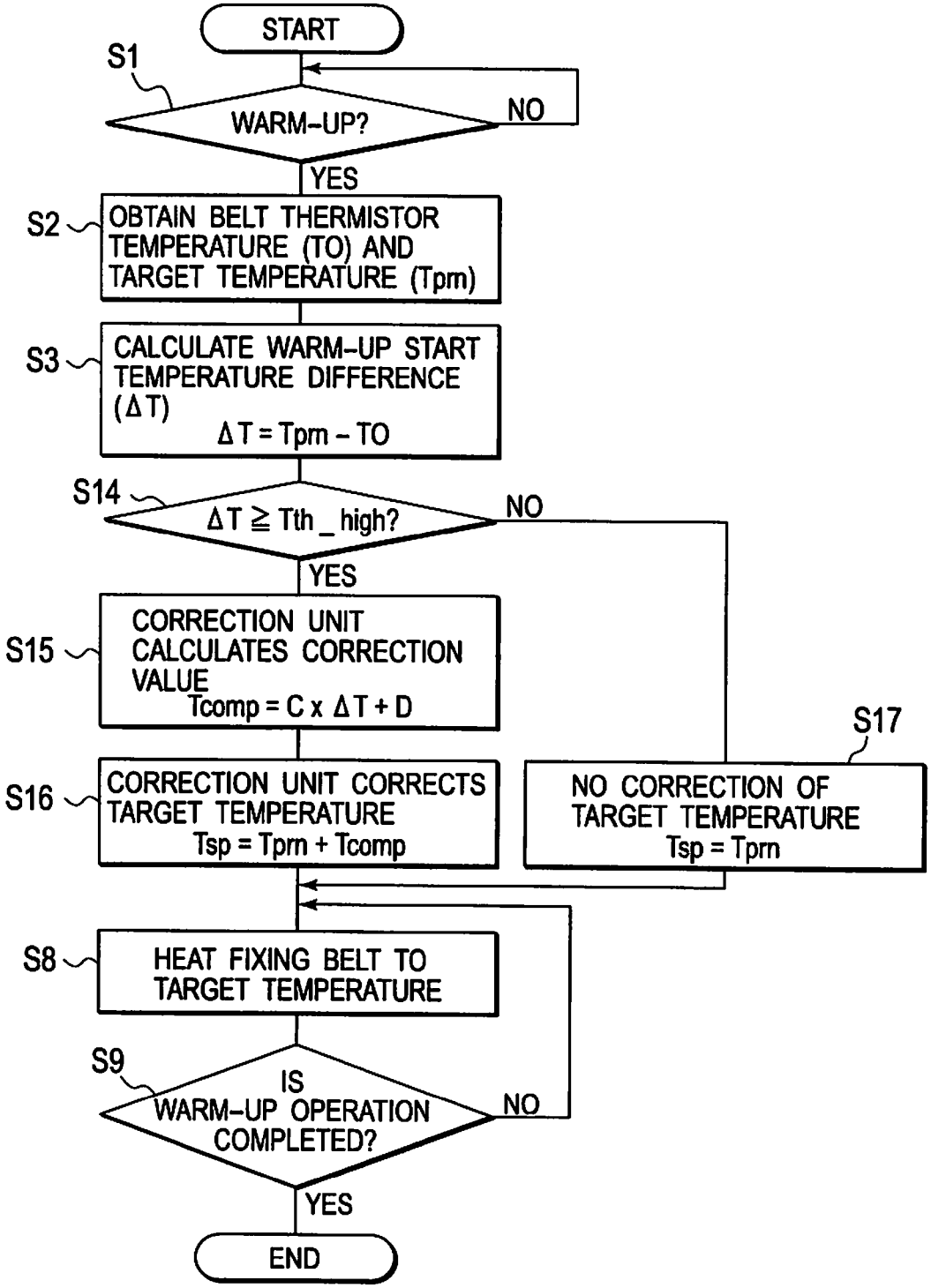
FIG. 13 is a flow chart showing a temperature control operation for fixing unit 10A shown in FIG. 10.

FIG. 13 is a flow chart showing the temperature control operation of fixing unit 10A of FIG. 10. In FIG. 13, the same structures as those in FIG. 7 of the first embodiment are designated by the same reference numerals.

Print controller 20A executes the following steps S1 to S3, S14 to S17, S8, and S9 to fixing unit 10A. Note that the second embodiment executes steps S14 to S17 whish are different from steps S4 to S7 in the first embodiment.

As in the first embodiment, after starting to operate fixing unit 10, print controller 20A detects whether a warm-up operation occurs or not in step S1, and proceeds to step S2 when the warm-up operation occurs (Y). In step S2, print controller 20A obtains temperature T0 detected by belt thermistor 13 and default target temperature Tprn, before starting heat control of fixing heater 18. Correction unit 23*a* calculates warm-up start temperature difference ΔT (ΔT=Tprn−T0) in step S3 and compares warm-up start temperature difference ΔT with threshold temperature Tth_high in step S14.

When the comparison result in step S14 determines that warm-up start temperature difference ΔT is equal or greater than Tth_high (ΔT≧Tth_high) (Y), correction unit 23*a* calculates the correction value Tcomp (Tcomp=C×ΔT+D) in step S15 and corrects default target temperature Tprn to target temperature Tsp (Tsp=Tprn+Tcomp) in step S16, and proceeds to step S8. When the comparison result in step S14 determines that warm-up start temperature difference (ΔT<Tth_high) (N), correction unit 23*a* does not execute the correction of default target temperature Tprn and sets the default target temperature Tprn as the target temperature Tsp (Tsp=Tprn) in step S17, and proceeds to step S8.

In step 8, as in the first embodiment, heat controller 21 turns on fixing heater 18 to heat fixing belt 11 to target temperature Tsp, and proceeds to step S9. In step S9, print controller 20A determines whether the widthwise center temperature of fixing belt 11, which is the temperature detected by belt thermistor 13, reaches target temperature Tsp, and turns off the fixing heater 18 to end the warm-up operation if the widthwise center temperature reaches target temperature Tsp (Y), and the temperature control operation is thus ended.

After that, print controller 20A executes the printing operation upon receiving a print instruction from the image forming apparatus body, or proceeds to waiting operation when print controller 20 does not receive the print instruction, as in the first embodiment.

Effect of the Second Embodiment

Figure 14A:
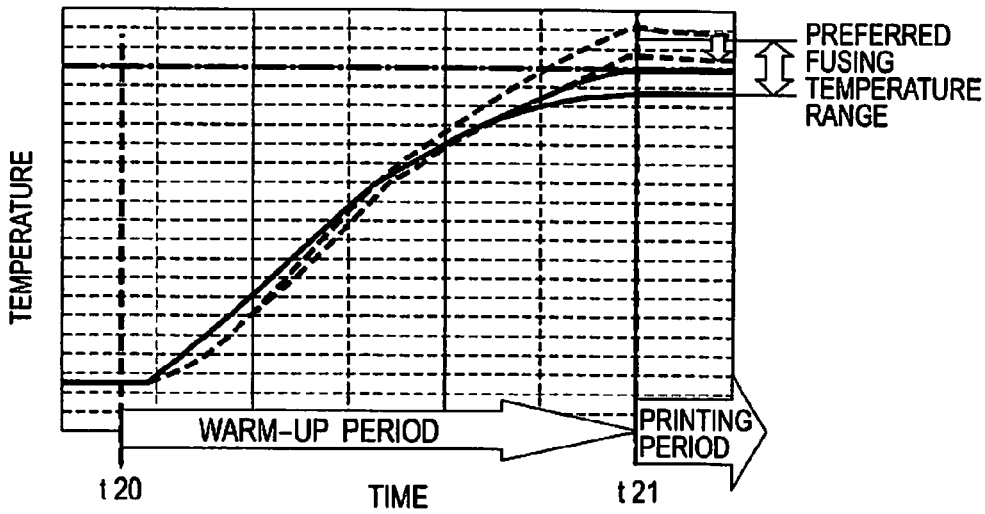
FIGS. 14A and 14B show effects caused by the temperature control for fixing unit 10A shown in FIG. 10.
Figure 14B:
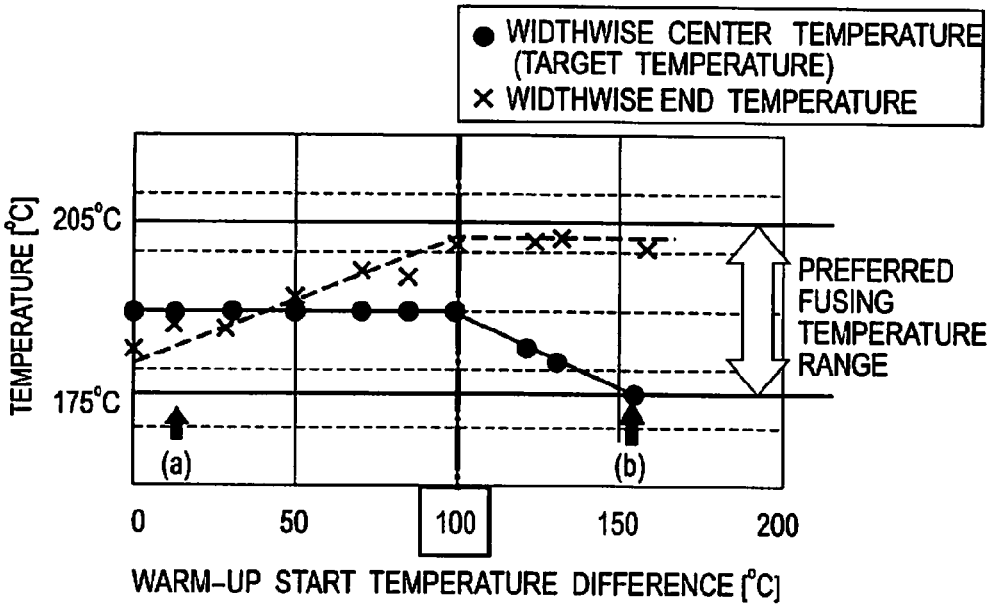

FIGS. 14A and 14B show effects of the heat control for fixing unit 10A of FIG. 10. FIG. 14A corresponds to FIG. 11A, and FIG. 14B corresponds to FIG. 12. FIGS. 14A and 14B correspond to FIGS. 8A and 8B of the first embodiment.

Since the second embodiment executes the above described heat control operation using fixing heater 18 having the non-uniform heat distribution, the widthwise center temperature and the widthwise end temperature of fixing belt 11 fall in the preferred fusing temperature range regardless of the warm-up start temperature difference ΔT, even in a case where the widthwise end of fixing belt 11 was above the preferred fusing temperature range after the conventional warm-up operation, as shown in FIG. 14A.

As described above, the second embodiment uses one fixing heater 18 and one belt thermistor 13 and corrects the default target temperature to the target temperature, depending on the warm-up start temperature difference, which is the difference between the temperature of the widthwise center of fixing belt 11 at the warm-up start time and the default target temperature of the widthwise center of fixing belt 11. Accordingly, the second embodiment can heat the entire width of fixing belt 11 to the preferred fusing temperature range, while using fixing heater 18 whose widthwise end generates more heat than its widthwise center. The second embodiment can thus prevent printing failure with a simple structure and a simple control. Therefore, the second embodiment prevents printing failure without using any other temperature detector other than belt thermistor 13 provided at the widthwise center of fixing belt 11, thereby decreasing the number of components of the image forming apparatus.

(Modifications)

The invention is not limited to the above described embodiments and includes various applications and modifications. The applications or the modifications include, for example, the followings (a) and (b).

Figure 15A:
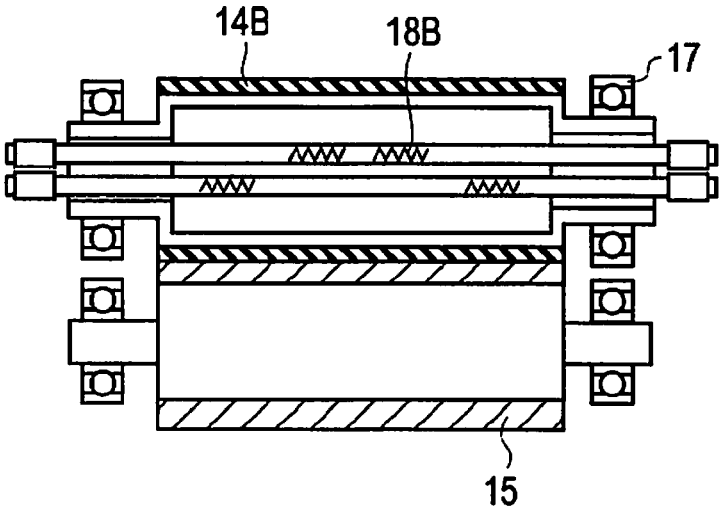
FIGS. 15A and 15B are diagrams of a modification of the fixing unit, which is roller type fixing unit 10B.
Figure 15B:
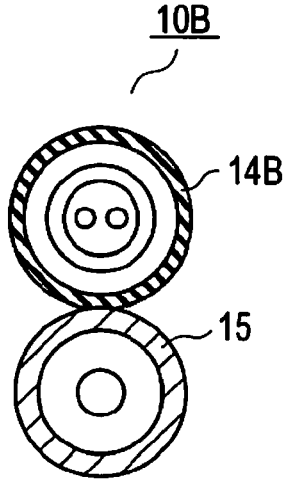

(a) FIGS. 15A and 15B show a diagram of a roller type fixing unit 10B which is a modification of the fixing unit. FIG. 15A is a sectional side view of fixing unit 10B, and FIG. 15B is a sectional front view of fixing unit 10B. In FIGS. 15A and 15B, the same configurations as in FIGS. 10A and 10B of the second embodiment are designated by the same reference numerals.

Roller type fixing unit 10B includes a pair of upper pressure roller 14B and lower pressure roller 15 supported by supporting members 17 and being in press contact with each other. In upper pressure roller, there are plural halogen heaters 18B which control the temperature of upper pressure roller 14B along the axial direction of upper pressure roller 14B.

The heat control described in the first embodiment or second embodiment can be applied to such roller type fixing unit 10B which activates the plural halogen heaters 18B at the same time in a warm-up operation, thereby heating the widthwise ends as well as the widthwise center of upper pressure roller 14 to the preferred fixing temperature range at the end of the warm-up operation, without adding another temperature detector to belt thermistor 13 provided at the width center of upper pressure roller 14B.

(b) The image forming apparatus of the invention is not limited to a printer as in the first and second embodiment, but can be applied to a multi-function printer or peripheral (MFP), a facsimile machine, a copy machine, or the like.

What is claimed is:

1. An image forming apparatus comprising:

a heat transfer member having a width extending along a direction orthogonal to a medium conveying direction along which a medium is conveyed, the heat transfer member transferring heat from a heater to the medium;

the heater provided along substantially the entire width of the heat transfer member and configured to heat the heat transfer member so as to heat the medium via the heat transfer member;

a temperature detector configured to detect the temperature of the widthwise center of the heat transfer member;

a heat controller configured to control the heater to make the temperature detected by the temperature detector a target temperature; and a correction unit configured correct the target temperature, depending on a difference between the target temperature and the temperature that is detected by the temperature detector.

2. The image forming apparatus according to claim 1, wherein the temperature detector is a thermistor.

3. The image forming apparatus according to claim 1, wherein the heat transfer member is a belt configured to be in contact with the medium while moving in the medium conveying direction and transferring the heat from the heater to the medium.

4. The image forming apparatus according to claim 1, wherein the heat transfer member is a roller configured to be in contact with the medium while rotating in the medium conveying direction and transferring the heat from the heater to the medium.

5. The image forming apparatus according to claim 1, wherein the heater has a plate shape extending in the widthwise direction of the heat transfer member.

6. The image forming apparatus according to claim 1, wherein the heater has a cylindrical shape extending in the widthwise of the heat transfer member.

7. The image forming apparatus according to claim 1, wherein the heater is a halogen lamp heater.

8. The image forming apparatus according to claim 1, wherein heat generation of the heater is uniform along the widthwise direction of the heat transfer member.

9. The image forming apparatus according to claim 8, wherein the correction unit is configured to correct the target temperature to be greater when the difference is less than a threshold.

10. The image forming apparatus according to claim 8, wherein the correction unit is configured to correct the target temperature only when the difference is less than a threshold.

11. An image forming apparatus comprising:

a heat transfer member having a width extending along a direction orthogonal to a medium conveying direction along which a medium is conveyed, the heat transfer member transferring heat from a heater to the medium;

the heater provided along substantially the entire width of the heat transfer member and configured to heat the heat transfer member so as to heat the medium via the heat transfer member;

a temperature detector configured to detect the temperature of the widthwise center of the heat transfer member;

a heat controller configured to control the heater to make the temperature detected by the temperature detector a target temperature; and a correction unit configured correct the target temperature, depending on a difference between the target temperature and the temperature that is detected by the temperature detector, wherein heat generation at the widthwise end of the heater is greater than that at the widthwise center of the heater.

12. The image forming apparatus according to claim 11, wherein the correction unit is configured to correct the target temperature to be smaller, when the difference is greater than a threshold.

13. The image forming apparatus according to claim 11, wherein the correction unit is configured to correct the target temperature, only when the difference is greater than a threshold.

14. An image forming apparatus, comprising:

a heat transfer member having a width extending along a direction orthogonal to a medium conveying direction along which a medium is conveyed, the heat transfer member transferring heat from a heater to the medium;

the heater provided along substantially the entire width of the heat transfer member and configured to heat the heat transfer member so as to heat the medium via the heat transfer member;

a temperature detector configured to detect the temperature of the widthwise center of the heat transfer member;

a temperature setting unit configured to set a target temperature based on a comparison in which a predetermined temperature is compared with the temperature that is detected by the temperature detector;

a heat controller configured to control the heater to make the temperature detected by the temperature detector the target temperature.

15. The image forming apparatus according to claim 14, wherein:

the heat transfer member is a belt configured to be in contact with the medium and to transfer heat from the heater to the medium.

16. The image forming apparatus according to claim 15, further comprising pressure rollers configured to move the belt in the medium conveying direction and press the medium via the belt.

17. The image forming apparatus according to claim 14, wherein the heater extends in the widthwise direction of the heat transfer member.

18. The image forming apparatus according to claim 14, wherein the temperature detector is a thermistor.

19. An image forming apparatus comprising:

a heat transfer member having a width extending along a direction orthogonal to a medium conveying direction along which a medium is conveyed, the heat transfer member transferring heat from a heater to the medium;

the heater provided along substantially the entire width of the heat transfer member and configured to heat the heat transfer member so as to heat the medium via the heat transfer member;

a temperature detector configured to detect the temperature of the widthwise center of the heat transfer member;

a temperature setting unit configured to set a target temperature by correcting a default target temperature, depending on a difference between the default target temperature and the temperature that is detected by the temperature detector;

a heat controller configured to control the heater to make the temperature detected by the temperature detector the target temperature.

20. An image forming apparatus of claim 1, wherein the correction unit is configured correct the target temperature, depending on a difference between the target temperature and the temperature that is detected by the temperature detector when the heater starts to heat.

21. An image forming apparatus of claim 1, wherein the correction unit is configured correct the target temperature, depending on a difference between the target temperature and the temperature that is detected by the temperature detector before the heater starts to heat.

* * * * *